US009909577B2

(12) United States Patent
Adair

(10) Patent No.: US 9,909,577 B2
(45) Date of Patent: Mar. 6, 2018

(54) DYNAMIC VARIABLE ORIFICE FOR COMPRESSOR PULSATION CONTROL

(71) Applicant: Jared W. Adair, Cypress, TX (US)

(72) Inventor: Jared W. Adair, Cypress, TX (US)

( * ) Notice: Subject to any disclaimer, the term of this patent is extended or adjusted under 35 U.S.C. 154(b) by 424 days.

(21) Appl. No.: 14/602,515

(22) Filed: Jan. 22, 2015

(65) Prior Publication Data

US 2015/0204317 A1 Jul. 23, 2015

Related U.S. Application Data

(60) Provisional application No. 62/033,835, filed on Aug. 6, 2014, provisional application No. 61/930,275, filed on Jan. 22, 2014.

(51) Int. Cl.
*F04B 11/00* (2006.01)
*F04B 39/00* (2006.01)

(52) U.S. Cl.
CPC ..... *F04B 11/0091* (2013.01); *F04B 39/0027* (2013.01); *F04B 39/0055* (2013.01); *F04B 39/0072* (2013.01)

(58) Field of Classification Search
CPC ..... F04B 39/0027; F04B 11/0091; F04B 39/0038; F04B 39/0055; F04B 39/0072; F04B 39/0083; F04B 11/00
See application file for complete search history.

(56) References Cited

U.S. PATENT DOCUMENTS

| | | | | |
|---|---|---|---|---|
| 1,986,252 | A * | 1/1935 | Conran | F16K 3/085 137/383 |
| 4,516,606 | A * | 5/1985 | Worley | F15D 1/0005 137/625.3 |
| 8,740,581 | B2 | 6/2014 | Nored et al. | |
| 8,997,627 | B2 * | 4/2015 | Passarelli | F01B 31/26 91/491 |
| 2009/0191076 | A1 | 7/2009 | Deffenbaugh et al. | |
| 2011/0243761 | A1 * | 10/2011 | Darsey | F04B 39/0055 417/312 |
| 2012/0003106 | A1 | 1/2012 | Deffenbaugh et al. | |
| 2014/0196535 | A1 * | 7/2014 | Sawchuk | G01F 15/00 73/272 R |

* cited by examiner

*Primary Examiner* — Peter J Bertheaud
*Assistant Examiner* — Dnyanesh Kasture
(74) *Attorney, Agent, or Firm* — Hasse & Nesbitt; Ronald J. Richter

(57) ABSTRACT

An apparatus for providing a selectively variable orifice size for pulsation control in a reciprocating compressor system includes a rotatable upper windowed plate and a fixed lower windowed plate, the windowed plates being aligned a long a central axis to form a central cylindrical port. The upper and lower windowed plates each include at least one plate port and have mating contours allowing the upper plate to rotatably slide over the fixed lower plate, allowing their respective ports to be selectively aligned in any configuration to create any desired orifice size for a pulsation control device. The shapes of the windowed plates can be flat, conical, or any combination thereof. In one embodiment, the upper and lower windowed plates each include a plurality of plate ports which can be selectively aligned, the relative alignment of the plurality of plate ports determining the effective orifice size of the pulsation control device.

9 Claims, 12 Drawing Sheets

| | OPTIMAL | COMMON | OPTIMAL | COMMON | OPTIMAL | COMMON |
|---|---|---|---|---|---|---|
| OPERATING CASE | 1 | | 3 | | 8 | |
| LOAD STEP | CYL 1- DA; ADDED HE CLEARANCE<br>CYL 2- DA; ADDED HE CLEARANCE<br>CYL 3- DA; ADDED HE CLEARANCE<br>CYL 4- DA; ADDED HE CLEARANCE | | CYL 1- SACE<br>CYL 2- SACE<br>CYL 3- SACE<br>CYL 4- DA; ADDED HE CLEARANCE | | CYL 1- DA; NOMINAL HE CLEARANCE<br>CYL 2- DA; NOMINAL HE CLEARANCE<br>CYL 3- DA; NOMINAL HE CLEARANCE<br>CYL 4- DA; NOMINAL HE CLEARANCE | |
| SUCTION TEMPERATURE (°F) | 62 | | 62 | | 61 | |
| SUCTION PRESSURE (PSIG) | 705 | | 735 | | 850 | |
| DISCHARGE PRESSURE (PSIG) | 981 | | 981 | | 1000 | |
| SPEED (RPM) | 1200 | | 1084 | | 1200 | |
| POWER REQUIRED (HP) | 1370 | | 784 | | 1245 | |
| FLOW RATE (MMSCFD) | 86.5 | | 58.0 | | 149.9 | |
| SUCTION BOTTLE INLET ORIFICE DIA. (IN.) | 7.44 | 5.50 | 4.25 | 5.50 | 7.44 | 5.50 |
| CYLINDER SUCTION FLANGE ORIFICE DIA. (IN.) | 3.75 | 3.75 | 3.75 | 3.75 | 5.00 | 3.75 |
| CYLINDER DISCHARGE FLANGE ORIFICE DIA. (IN.) | 3.75 | 3.50 | 3.75 | 3.50 | 5.50 | 3.50 |
| DISCHARGE BOTTLE OUTLET ORIFICE DIA. (IN.) | 5.50 | 4.25 | 3.50 | 4.25 | 5.50 | 4.25 |
| SUCTION LINE PRESSURE DROP (PSI) | 10.8 | 13.8 | 11.6 | 6.1 | 11.0 | 33.6 |
| SUCTION LINE PRESSURE DROP (%) | 1.53% | 1.96% | 1.58% | 0.83% | 1.29% | 3.95% |
| SUCTION LINE POWER (HP) | 13.7 | 17.4 | 9.8 | 5.2 | 19.2 | 58.5 |

1 continued to FIG. 11B 1 continued to FIG. 11B

FIG. 11A continued from FIG. 11A 1 continued from FIG. 11A 1

| | | | | | | |
|---|---|---|---|---|---|---|
| SUCTION LINE PULSATION (PSI) | 15.9 | 13.7 | 54.0 | 88.2 | 5.7 | 4.3 |
| SUCTION LINE PULSATION (% OF AVERAGE PRESSURE) | 2.2% | 1.9% | 7.2% | 11.8% | 0.7% | 0.5% |
| DISCHARGE LINE PRESSURE DROP (PSI) | 9.7 | 18.9 | 15.6 | 8.9 | 12.1 | 52.1 |
| DISCHARGE LINE PRESSURE DROP (%) | 0.99% | 1.93% | 1.59% | 0.91% | 1.21% | 5.21% |
| DISCHARGE LINE POWER (HP) | 9.4 | 18.2 | 10.6 | 6.2 | 18.4 | 79.2 |
| DISCHARGE LINE PULSATION (PSI) | 13.9 | 13.0 | 55.7 | 57.6 | 1.7 | 1.7 |
| DISCHARGE LINE PULSATION (% OF AVERAGE PRESSURE) | 1.4% | 1.3% | 5.6% | 5.8% | 0.2% | 0.2% |
| TOTAL PRESSURE DROP (PSI) | 2.5 | 32.7 | 27.2 | 15 | 23.1 | 85.7 |
| TOTAL LINE POWER (HP) | 23.1 | 35.6 | 20.4 | 11.4 | 37.6 | 137.7 |
| % SYSTEM POWER COST | 1.69% | 2.60% | 2.60% | 1.45% | 3.02% | 11.06% |
| DAILY FUEL COST AT $3.50/MMBTU | $13.58 | $20.93 | $12.00 | $6.70 | $22.11 | $80.97 |
| SAVINGS PER DAY | $7.35 | | $(5.29) | | $58.86 | |
| SAVINGS PER YEAR AT 96% UTILIZATION | $2,575.44 | | $(1,584.32) | | $20,624.12 | |

| | | | | | | |
|---|---|---|---|---|---|---|
| SUCTION LINE PULSATION (% OF GUIDLINE LIMIT) | 192% | 165% | 636% | 1005% | 84% | 64% |
| DISCHARGE LINE PULSATION (% OF GUIDLINE LIMIT) | 127% | 118% | 509% | 527% | 46% | 43% |

FIG. 11B

DYNAMIC VARIABLE ORIFICE FOR COMPRESSOR PULSATION CONTROL

CROSS-REFERENCE TO RELATED APPLICATIONS

This application claims the benefit of U.S. Provisional Application 61/930,275, filed Jan. 22, 2014 and U.S. Provisional Application 62/033,835, filed Aug. 6, 2014, the disclosures of which are incorporated herein by reference in their entirety.

FIELD OF THE INVENTION

The present invention relates in general to the control of the flow of pressurized fluids through industrial and commercial piping systems, and in particular to a dynamic variable device for dampening pressure and flow pulsations passing through these systems, especially to systems that include one or more reciprocating (piston-type) compressor cylinders with variable operating conditions.

BACKGROUND OF THE INVENTION

Reciprocating compressors typically include one or more pistons that "reciprocate" within closed cylinders. They are commonly used for a wide range of applications that include, but are not limited to, the pressurization and transport of air, natural gas, and other gases and mixtures of gases through systems that are used for gas transmission, distribution, injection, storage, processing, refining, oil production, refrigeration, air separation, utility, and other industrial and commercial processes. Reciprocating compressors typically draw a fixed mass of gaseous fluid at a relatively lower pressure from a suction pipe and, a fraction of a second later, compress and transfer the fixed mass of fluid into a discharge pipe at a relatively higher pressure.

The intermittent mass transfer within reciprocating compressor systems produces complex time-variant pressure waves, commonly referred to as pulsations. The pulsations are affected by the compressor operating speed, temperature, pressure, and thermodynamic properties of the gaseous fluid, and the geometry and configuration of the reciprocating compressor and the system to which it is connected. For example, a reciprocating compressor cylinder that compresses gas on only one end of its piston, referred to as a single-acting compressor, produces pulsation having a fundamental frequency that is equal to the compressor operating speed. Similarly, a reciprocating compressor cylinder that compresses gas on both ends of its piston, referred to as a double-acting compressor, produces pulsation having a fundamental frequency that is equal to twice the compressor operating speed. In addition, the compressor cylinders and piping systems have individual acoustic natural frequencies that affect the magnitude and frequencies of the combined pulsations throughout the system.

These pressure pulsations travel as waves through an often complex network of connected pipes, pressure vessels, filters, separators, coolers and other system elements. They can travel for many miles until they are attenuated or damped by friction or other means that reduce the dynamic variation of the pressure.

The pulsations may excite system mechanical natural frequencies, cause high vibration, overstress system elements and piping, interfere with meter measurements, and affect compressor thermodynamic performance. These effects can severely compromise the reliability, performance and structural integrity of the reciprocating compressor and its connected system, as well as flow meters and other compressors connected to the system.

Therefore, effective reduction and control of the pressure and flow pulsations generated by reciprocating compressors, both upstream (i.e., the suction side) and downstream (i.e., the discharge side) of the compressor, is necessary for safe and efficient operation. Current technology involves creating a detailed model of the compressor and its system that is used to predict its pulsation behavior at the specified operating conditions, which are often variable. When such modeling predicts pulsations, associated shaking forces, and component stresses that are judged to be beyond safe limits, based on accepted industry guidelines, sound engineering analysis and/or practical experience, it is customary to employ a system of pulsation attenuation elements.

Common pulsation attenuation elements include pulsation bottles (expansion volumes, often containing internal baffles, multiple chambers and choke tubes), external choke tubes, additional pulsation bottles, and fixed orifice plates installed at specific locations in the both the suction and discharge side of each compressor cylinder. These prior art pulsation attenuation devices can be used singly or in combination to dampen the pressure waves and reduce the resulting forces to acceptable levels. These devices typically accomplish pulsation attenuation by adding resistance to the system. This added resistance causes system pressure losses and energy losses both upstream and downstream of the compressor cylinders. The pressure and energy losses typically increase as the frequency of the pulsation increases, and these losses add to the work that must be done by the compressor to move fluid from the suction line to the discharge line.

Of the aforementioned pulsation attenuation elements, fixed orifice plates are one of the most common elements employed. They have the advantages of relatively easy installation and low cost. They may be used at multiple locations throughout the system. The fixed orifices are typically thin metal sheets having a round hole of a specified diameter, located at the center of the flow channel (usually a pipe) cross-section. The orifice diameter is generally 0.5 to 0.7 times the inside diameter of the pipe in which it is installed. However, smaller and larger diameter ratios are sometimes used. The orifice plate is retained between two adjacent pipe flanges that are held together with multiple threaded fasteners and sealed with gaskets to prevent gas leaks. Once the flanges are installed the orifice plates remain fixed in place, and can only be removed or changed by safely stopping the compressor, completely venting all gas to atmospheric pressure, loosening all the threaded fasteners, removing the original orifice plate, installing a new orifice plate with new gaskets, re-assembling and tightening the threaded fasteners, purging the system to remove air, pressurizing the system with gas and restarting the compressor.

In the majority of applications, compressor operating conditions vary with time, with the variables being speed, suction pressure/temperature, discharge pressure/temperature, displacement, effective clearance volume, and even the gas composition. Operating condition variations may be gradual over time, but are more often intermittent, changing frequently to higher or lower levels as dictated by the demands of the application. Some applications, e.g., natural gas transmission and gas storage, have extreme variations in operating conditions over time. In fact, the majority of reciprocating applications require operation over a wide speed range of conditions as well as multiple flow rates that range from very low flows to very high flows.

Fixed orifice plates are effective in reducing pulsations over a narrow compressor operating range, however they cause an associated pressure drop that adds to the work and power consumption required by the compressor. The system pulsation control design is almost always a compromise between pulsation control and pressure drop or power penalty. For example, a very restrictive (low diameter ratio) fixed orifice plate may be required to adequately dampen pulsations at certain operating conditions. However, at other operating conditions, the pulsations might be acceptable with a less restrictive (larger diameter ratio) fixed orifice plate or possibly with no orifice plate at all. In addition, a fixed orifice plate that controls pulsations with a tolerable pressure drop and power penalty at some conditions, may cause excessive damping, pressure drop and power penalty at other conditions.

There are therefore multiple challenges when trying to achieve pulsation control with pulsation bottles and fixed orifice plates. A typical disclaimer by the pulsation control designer states that, "Orifice and choke tube diameters are selected to provide the optimum pulsation dampening and pressure drop over the entire operating range of the unit. Typically, the predicted pressure drop levels for the compressor will range from at or below American Petroleum Institute Specification No. 618 (API 618) allowable levels at normal and low flow conditions to above API 618 allowable levels at high flow conditions. Additionally, the pulsation dampening will be generally good at normal and high flow conditions, but may be marginal to poor at certain frequencies when operating at the minimum flow conditions."

Although a fixed orifice plate having a specific diameter may be necessary and effective for pulsation control at one set or range of operating conditions, it may be unnecessary, ineffective, and/or the cause of unacceptably high pressure drop and associated power consumption at other ranges of operating conditions. Therefore, it would be advantageous to change one or more fixed orifice plate diameters as operating conditions change.

As noted above, fixed orifice plates are commonly placed between two mating flanges that are held together with multiple threaded studs and nuts and sealed with gaskets to prevent leakage of process gas to the atmosphere. Optionally, they may be permanently welded into the inside of the piping or other flow passage. Accordingly, the downtime, labor and lost production required for changing fixed orifice plates make this alternative impractical. As a result, compressor systems tend to run with higher pressure and power losses or with higher pulsation induced vibration, and associated risk, than would be optimal if the orifice size could be changed when dictated by operating conditions. In many cases the range of operating conditions has to be reduced or limited to restrict the operation of the compressor system.

In light of the above, there is therefore a need for a practical device that can change the effective orifice resistance to maintain acceptable pulsation control with minimal pressure drop and power consumption as operating conditions change. There is also a need for a device and a means that could quickly and easily change the effective diameter (or flow restriction) while the compressor is pressurized and operating. Such a device would enable the optimal and safe control of pulsations, while minimizing power consumption.

SUMMARY OF THE INVENTION

Accordingly, the present invention relates to a device for adjusting the effective orifice size or restriction of a pulsation control orifice, termed a "dynamic variable orifice" (DVO). The invention provides a practical means of changing the effective orifice sizes to optimal values in response to changing compressor operating conditions. The DVO can be adjusted while the compressor is operating and pressurized, and allows a user to increase or decrease the effective orifice size or restriction. The orifice size of the DVO can be adjusted manually with a wrench or hand crank, or automatically with the assistance of an electrical, pneumatic or hydraulically powered actuator or motor. The power-assisted adjustment may be controlled by a human operator, or by an automatic control system programmed to automatically adjust the orifice size as operating conditions change.

A first aspect of the invention provides, in a reciprocating compressor, an apparatus for controlling the effective orifice size of a pulsation control device, the apparatus comprising: (a) a rotatable upper windowed plate including at least one upper plate port; (b) a fixed lower windowed plate including at least one lower plate port; and (c) a central cylindrical port created by alignment of the upper and lower windowed plates about a central axis, wherein the upper and lower windowed plates have mating contours allowing the rotatable upper plate to slide over the fixed lower plate as it rotates about the central axis, rotation of the upper plate causing the upper and lower plate ports to be selectively aligned, the relative alignment of the plate ports determining the effective orifice size of a pulsation control device.

A second aspect of the invention provides an apparatus for providing a selectively variable orifice size for a pulsation control device associated with a reciprocating compressor, the apparatus comprising: (a) a rotatable upper windowed plate including a plurality of upper plate ports; (b) a fixed lower windowed plate including a plurality of lower plate ports; and (c) a central cylindrical port created by alignment of the upper and lower windowed plates about a central axis, wherein the upper and lower windowed plates have mating contours allowing the rotatable upper plate to slide over the fixed lower plate as it rotates about the central axis, rotation of the upper plate causing the upper and lower plate ports to be selectively aligned, the relative alignment of the plate ports determining the effective orifice size of a pulsation control device.

The shapes of the upper and lower windowed plates can be flat, conical, or a combination thereof. The upper windowed plate is typically rotated in one direction about the lower windowed plate to reduce the effective orifice size, and in an opposite direction to increase the effective orifice size.

The nature and advantages of the present invention will be more fully appreciated from the following drawings, detailed description and claims.

BRIEF DESCRIPTION OF THE DRAWINGS

The accompanying drawings illustrate embodiments of the invention and, together with a general description of the invention given above, and the detailed description given below, serve to explain the principles of the invention.

FIGS. 11 A and 11B are a tabulation of data comparing a case study of a reciprocating compressor with common and optimal pulsation orifice sets operating at three different operating conditions.

DETAILED DESCRIPTION OF THE INVENTION

The present invention relates to an apparatus for controlling/adjusting the effective orifice size or restriction of a pulsation control orifice for a reciprocating compressor. Termed a dynamic variable orifice apparatus or DVO, the invention provides a practical means for varying the effective orifice sizes to optimal values in response to changing operating conditions within the reciprocating compressor.

The DVO allows a user to control the pressure and flow pulsations generated by reciprocating compressors while the compressor is operating and pressurized. It can be adjusted manually with a wrench or hand crank, or with the assistance of an electrical, pneumatic or hydraulically powered actuator or motor. The power-assisted adjustment may be controlled by a human operator or by an automatic control system that is programmed to set the required orifice setting as operating conditions change.

Figure 1:
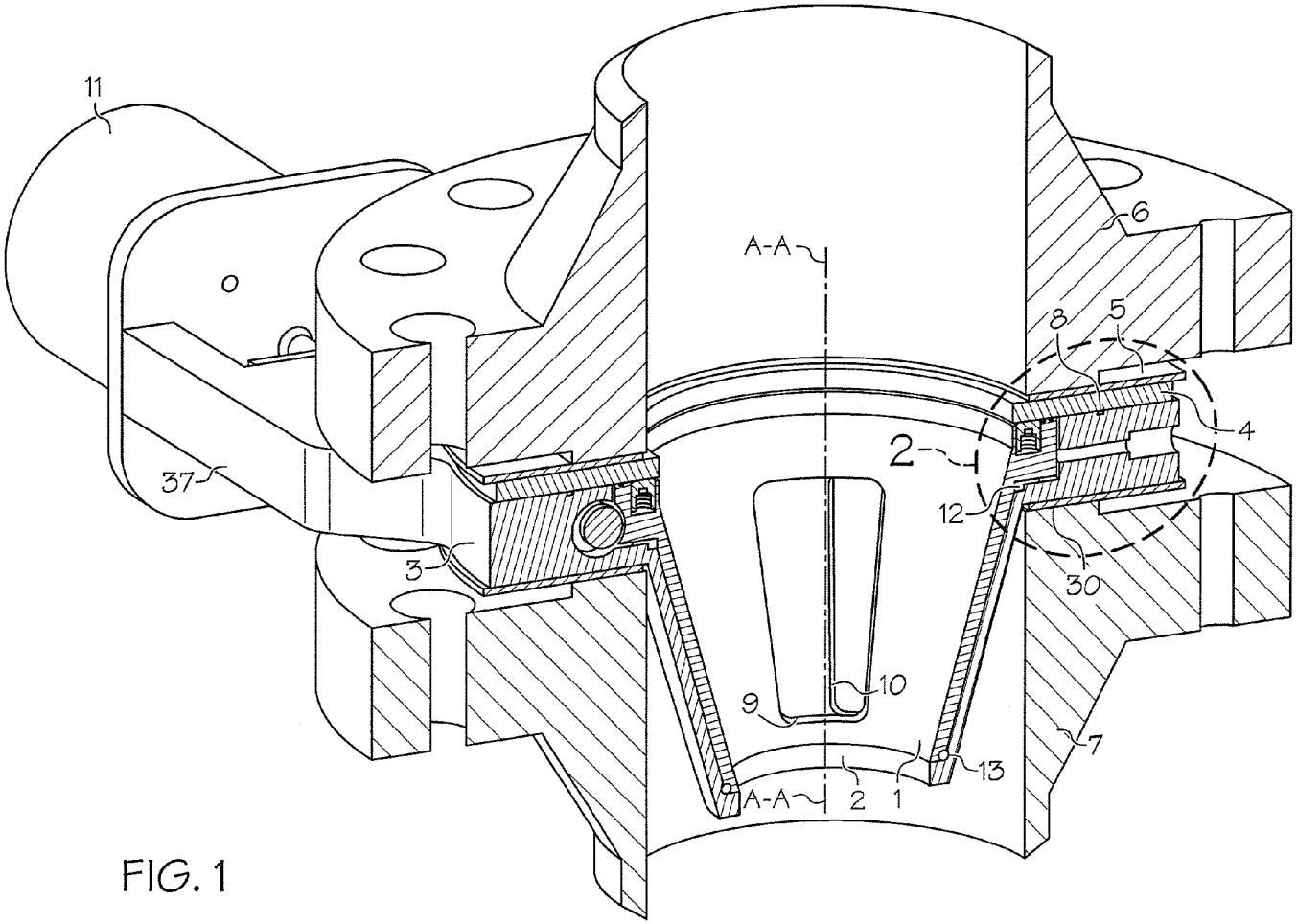
FIG. 1 is a side cross-sectional view of a 3-D representation of a conical embodiment of the apparatus of the invention.

One embodiment of a conical-shaped Dynamic Variable Orifice apparatus (DVO) of the present invention is shown in FIG. 1. The DVO can be installed as a complete assembly between adjacent bolted flanges, similar to a typical fixed orifice, except that the DVO assembly is significantly thicker than a typical flat plate fixed orifice. The bolted flanges are typically ANSI standard flanges; however, they may be other standard flanges or special non-standard flanges. A first gasket or seal 5 can be positioned between the top of the DVO assembly and the upper bolted flange 6. Similarly, a second gasket or seal 30 can be positioned between the bottom of the DVO assembly and the lower bolted flange 7. These two gaskets or seals prevent leakage of high pressure process gas to the atmosphere. The gaskets 5, 30 are made of a malleable material and are typically "crushed" (as is known in the art) by the force created by multiple threaded studs or bolts and nuts (not shown) that are tensioned by torque wrenches or mechanical means, or by the force created by other mechanical means (such as, but not limited to, clamps) in order to create a seal which prevents leakage of high pressure gas to the atmosphere.

Figure 2:
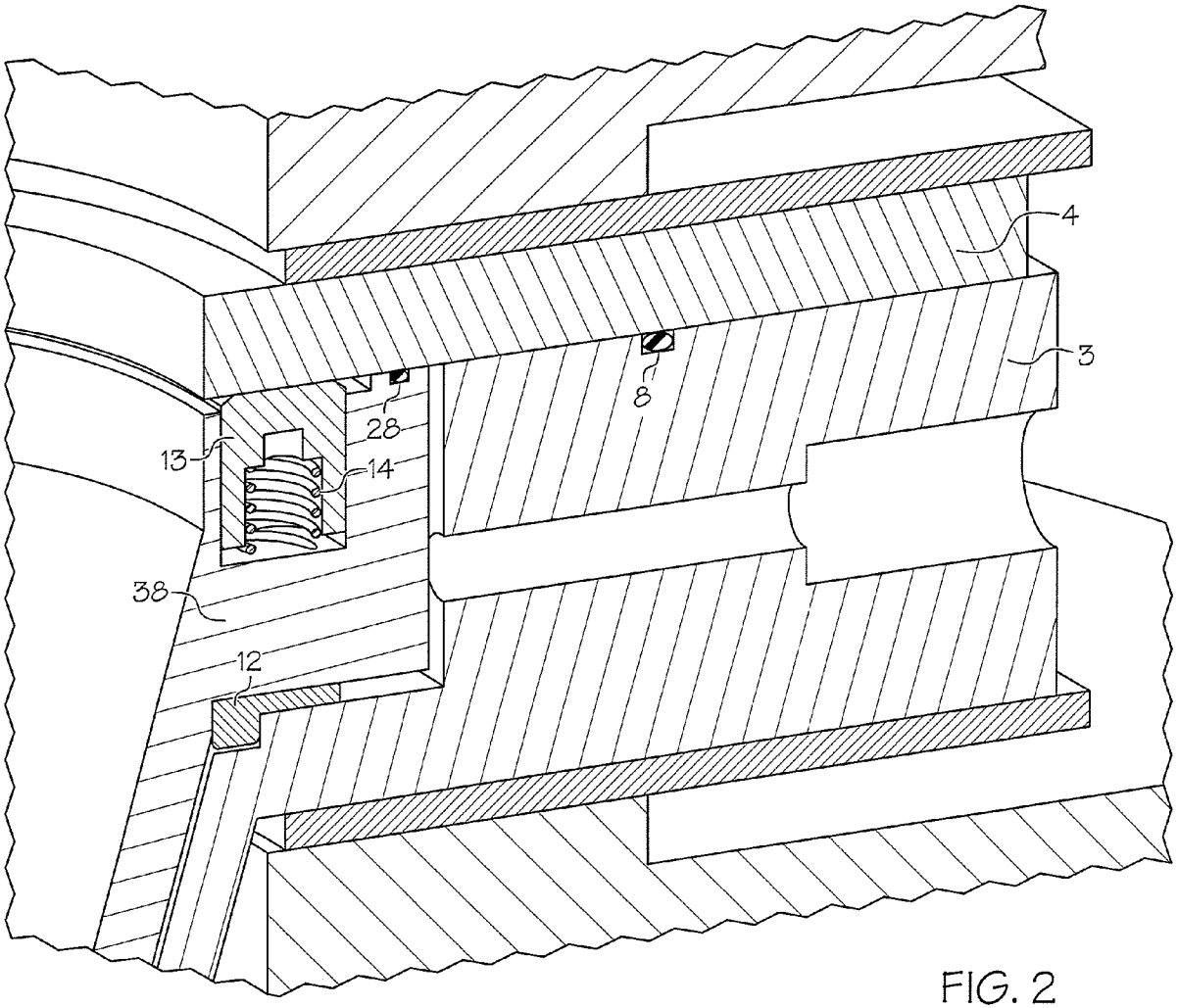
FIG. 2 is an expanded cross-sectional view of the area within the square frame shown in FIG. 1.
Figure 3:
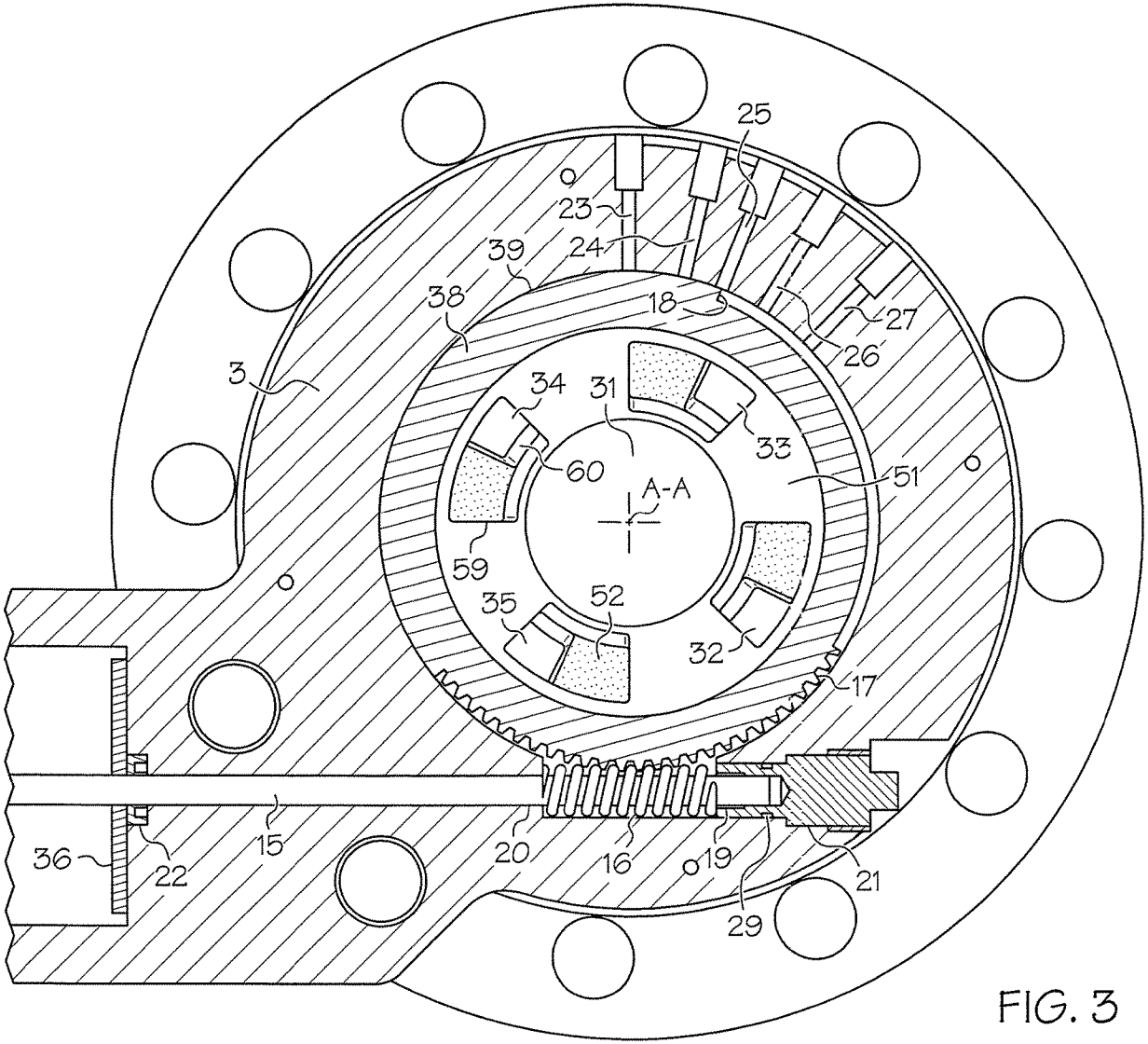
FIG. 3 is an expanded cross-sectional view as viewed from the top of a conical embodiment of the apparatus of the invention having a plurality of plate ports.

FIGS. 1-4 depict various views and details of a conical-shaped Dynamic Variable Orifice apparatus (DVO) of the present invention, while FIGS. 5-8 depict various views and details of a flat, disc-shaped DVO. The conical embodiments of the DVO as shown in FIGS. 1-4 includes a rotatable upper windowed plate 1 (FIGS. 1, 2), 51 (FIGS. 3, 4) and a fixed lower windowed plate 2 (FIGS. 1, 2), 52 (FIGS. 3, 4). Here, the upper 1, 51 and lower windowed plates 2, 52 can also be referred to as inner and outer conical cages, respectively. Viewing FIG. 3, wherein a plurality of plate ports for creating a plurality of openings 32, 33, 34, 35 between the upper and lower windowed plates are shown, it can be appreciated that a common, central cylindrical port 31 is formed by the upper and lower windowed plates 51, 52 being aligned about a central axis A-A.

Also, looking at FIG. 1, it can be appreciated that the upper and lower windowed plates have mating contours allowing the rotatable upper plate 1 (or here, inner conical cage) to rotatably slide over the fixed lower plate 2 (or outer conical cage) as it rotates about this central axis A-A. Rotation of the upper plate 1 relative to the fixed lower plate 2 causes their respective plate ports 9, 10 to be selectively aligned with one another. Therefore, the plate ports can be aligned in any configuration to create any size opening area or effective orifice size for a pulsation control device within a reciprocating compressor.

Figure 4A:
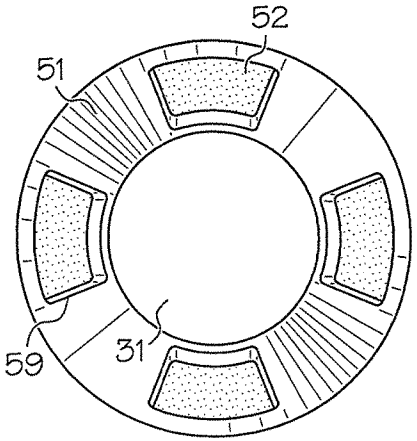
FIGS. 4A through 4E show a series of top views inside the upper windowed plate of the embodiment of FIG. 3, showing the flow passage openings in the plate ports as the upper windowed plate is rotated from a fully closed (4A) to a fully open (4E) position.

In use, flow enters the large internal diameter of the upper windowed plate and progresses through the smaller internal diameter of the central cylindrical port 31 (see FIG. 3) created by the upper windowed plate 51 and the lower windowed plate 52. Looking at FIG. 1, the relative alignment of the upper plate port 9 of the rotatable upper windowed plate 1 with the lower plate port 10 of the fixed lower windowed plate 2 determines opening area or the effective orifice size or restriction of the pulsation control device. Looking at FIG. 4, when the alignment between the two windowed plates 51, 52 is out of line, such that the opening between the upper and lower plate ports 59, 60 in the upper and lower windowed plates is substantially closed, as shown in FIG. 4A, all of the flow must pass through the central cylindrical port 31. This minimum position creates the smallest effective orifice size and the highest resistance to flow.

Figure 4B:
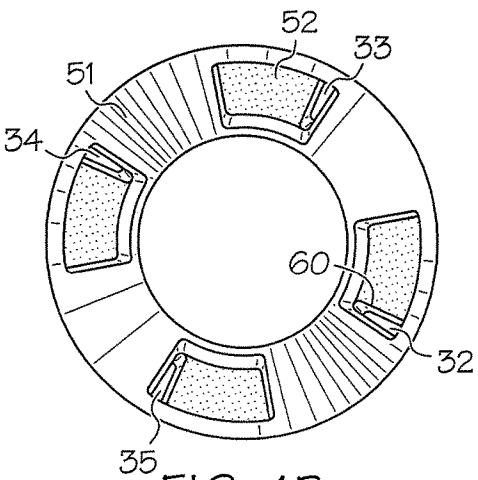
Figure 4C:
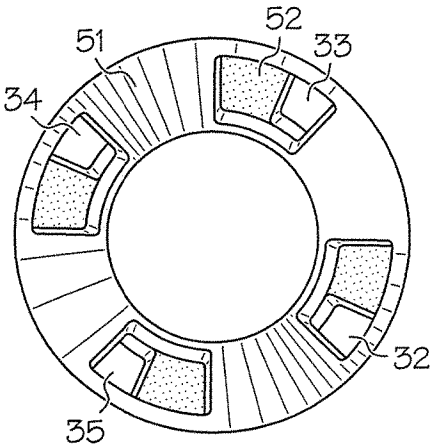
Figure 4D:
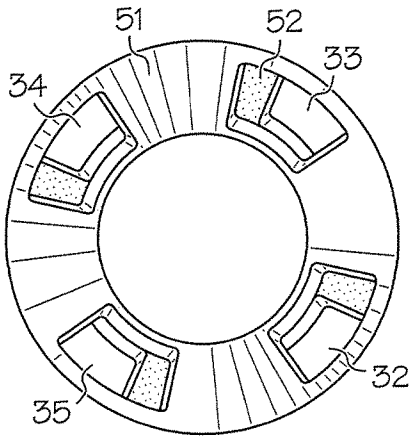
Figure 4E:
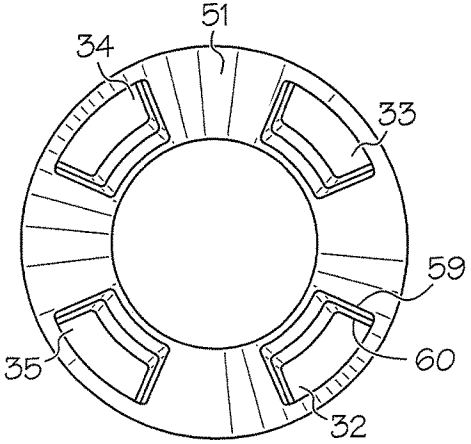

In a typical application, the DVO apparatus would be designed to have a "built-in" Beta ratio, defined as the effective orifice diameter of the DVO divided by the internal diameter of the flow channel or pipe into which the DVO is placed. At the minimum position described above the built-in Beta ratio would be equivalent to 0.4. However, the DVO could be designed with a built-in minimum Beta ratio as low as about 0.3 or lower, and to as high as about 0.7 or higher. As shown in FIG. 4B, rotating the upper windowed plate 51 in a clockwise direction relative to the lower windowed plate 52, gradually increases the area of the openings 32, 33, 34, 35 (see also FIG. 3) between the plurality of plate ports 59, 60 of the upper and lower windowed plates to permit flow to pass through the plate ports, as well as through the central cylindrical port 31. This increases the effective orifice size to a Beta ratio that is larger than the minimum built-in Beta ratio and reduces the resistance to flow. Further clockwise rotation of the upper windowed plate, as shown in FIGS. 4C and 4D, further increases the plate port areas and the effective orifice size to larger and larger Beta ratios, further reducing the resistance to flow. In the limiting case, the maximum position occurs when the upper windowed plate is rotated to a position where its plate ports are in line with the plate ports of the lower windowed plate, causing the plate port areas to be fully open (see FIG. 4E). This maximizes the effective orifice size and Beta ratio and minimizes the resistance to flow. In a typical application, the DVO would be designed with a "built-in" maximum Beta ratio of about 0.7. However, the DVO could be designed with a built-in maximum Beta ratio of as high as about 0.9 to a low of about 0.5 or lower. Any configuration of the ports of the upper windowed plate relative to the ports of the lower windowed plate can be applied, thus providing any effective orifice size.

As can be seen in FIG. 1, the upper windowed plate 1 is typically rotated in one direction within the lower windowed plate 2 to reduce the effective orifice size, and in an opposite direction to increase the effective orifice size. Looking at FIG. 3, the upper windowed plate 51 contains a flange 38 having gear teeth 17 located in a section of its lower rim that engage helical teeth 16 in a drive gear and shaft 15. As the drive gear and shaft 15 is rotated by a mechanical means, the helical teeth 16 engage the gear teeth 17 in the rim of the upper conical flange 39 to cause the upper windowed plate 1 to be rotated so as to change the orientation of the ports 59 in the upper windowed plate with respect to the ports 60 in the lower windowed plate 52. This allows the user to change the effective flow area or orifice area of the DVO while the compressor is operating and pressurized. An upper locator bushing 12 (see FIGS. 1 and 2) and a lower locator bushing 13 (see FIG. 1) align and position the upper windowed plate 1 to the lower windowed plate 2, providing radial and axial support and alignment, preventing vibratory motion of the upper windowed plate, and maintaining a small clearance between the cages to prevent metal-to-metal contact, wear, and excessive resistance to rotation of the upper windowed plate.

Looking at FIG. 3, one or more mechanical stops, markers or notches 18 may be located at another position in the rim 39 of the flange 38 of the upper windowed plate 51. These notches 18 can be used to locate or measure the angular position of the upper windowed plate 51 for orienting its ports 59 relative to the corresponding ports 60 in the lower windowed plate 52 to adjust the flow area through the openings 32, 33, 34, and 35 of the plate ports between the upper and lower windowed plates. As illustrated, ports 59 of the upper windowed plate line up with the ports 60 of the lower windowed plate 52 to form opening 34. Openings 33, 34 and 35 are also formed by the ports 59 and 60 (not labeled over these openings) of the upper and lower windowed plates 51, 52, respectively. One embodiment of the invention utilizes one or more markers, which may include, but are not limited to, step changes in the flange lower rim diameter, or metal pins affixed to protrude radially from the flange lower rim, or shallow holes drilled radially into the flange lower rim. The location of the marker(s) may be measured by an electronic sensor(s) mounted in one or more sensor ports 23, 24, 25, 26, 27 located within the flange 3 of the lower windowed plate 52 to determine the angular position of the upper windowed plate 51 as it is being rotated to a new position by the gear and shaft assembly 15.

In another embodiment, fixed mechanical stops embedded in the flange 38 of the upper windowed plate (not shown) contact a pin, step or other mechanical means of limiting rotational travel of the upper windowed plate 51 to a predetermined position. In this embodiment, the DVO is limited to positions corresponding to the limits imposed by fixed mechanical stops.

In yet another embodiment, the lower rim 39 of the flange of the upper windowed plate 51 may contain a notch (not shown) in the shape of a "v" groove, slot, hole or other geometric form. An external detent actuator (not shown), controlled by electrical, pneumatic or hydraulic or manual mechanical means, contains a pin that engages the "v" groove, slot, hole or other geometric form to prevent rotation of the upper windowed plate 51. The pin can be withdrawn from such engagement with the "v" groove when it is necessary to rotate the upper windowed plate 51 to a new position, and then reinserted when the new position is reached to hold the upper windowed plate in the new position.

Looking at FIG. 1, the lower windowed plate 2 contains an integral flange 3 which typically includes one or more extensions (e.g., 37). One extension may be used for mounting the external actuator or the electronic sensors (not shown). Another extension 37 may be used for mounting a pneumatic, electrical or hydraulic actuator or motor 11 or other means to rotate the drive gear and shaft assembly 15. The drive gear and shaft assembly 15 may be rotated in a clockwise or a counter-clockwise direction, either manually with a wrench engaging opposing flats on the shaft, or with a hand crank attached either permanently or temporarily to the shaft, or with an electrical, pneumatic or hydraulically powered actuator or motor that engages the drive end of the gear and shaft assembly 15.

As can be appreciated by viewing FIG. 3, the drive gear and shaft assembly 15 is held in position radially and axially by at least two bushings or bearings 19, 20. One bushing or bearing 20 is held within a cylindrical bore in the flange 3 of the lower windowed plate and the other bearing or bushing 19 is held in place by a bearing holder 21 that is inserted into a cylindrical bore in the flange 3 of the lower windowed plate. The bearing holder 21 may be secured by threads that engage it with threads in the cylindrical bore in the flange 3 of the lower windowed plate or by bolts, snap ring or other mechanical means. A seal 29 prevents leakage of high pressure gas to the atmosphere. A rotary shaft seal 22, held in place by a retainer 36 prevents high pressure gas from leaking along the shaft and gear assembly 15 to the atmosphere.

As shown in FIG. 2, the flange 38 of the upper windowed plate 1 is positioned within a shallow bore in the flange 3 of the lower windowed plate 2. A top plate 4, connected to the flange 3 of the lower windowed plate by three or more threaded cap screws (not shown), captures the flange 38 of the upper windowed plate to position it axially in the assembly. A seal 8 prevents the leakage of high pressure gas through the joint between the top plate 4 and the flange 3 of the lower windowed plate 2 to the atmosphere. A minimum of three to a maximum of about twelve spring-energized support pads 13 are used to provide a limited axial preload force which holds the upper windowed plate 1 in an axial position against the bushings 12, 13 within the assembly, but permits rotation when needed to change the effective orifice area. The support pads 13 are constructed of corrosion resistant metallic bearing material, such as bronze, brass, tin-plated or lead-plated aluminum or brass, or composite sintered metals, or a non-metallic bearing material, such as filled-Teflon, PEEK, or other suitable material. A helical spring 14 under each support pad is compressed within the assembly to provide a suitable axial force that holds the upper windowed plate in position, but permits rotation when it is necessary to rotate the upper windowed plate to a different position to change the effective orifice area. A contaminant barrier 28 may be used to prevent the accumulation of dirt, rust, liquid or other contaminants in the gas stream from accumulating around the gear teeth 16, 17 (FIG. 3).

In a different embodiment (not shown) the functions of the contaminant barrier 28 and the support pads 13 may be combined into a single non-metallic ring that is compressed by multiple helical springs 14, or by a single wafer spring, or by other type of springs.

The flat, disc-like embodiment of the DVO as shown in FIGS. 5-8 includes a rotatable upper windowed plate 201 and a fixed lower windowed plate 202. Viewing FIG. 7, wherein a plurality of plate ports 259, 260 for creating a plurality of openings 232, 233, 234, 235 between the upper and lower windowed plates are shown, it can be appreciated that a common central cylindrical port 231 is formed by the upper and lower windowed plates 201, 202 being aligned about a central axis B-B.

Figure 5:
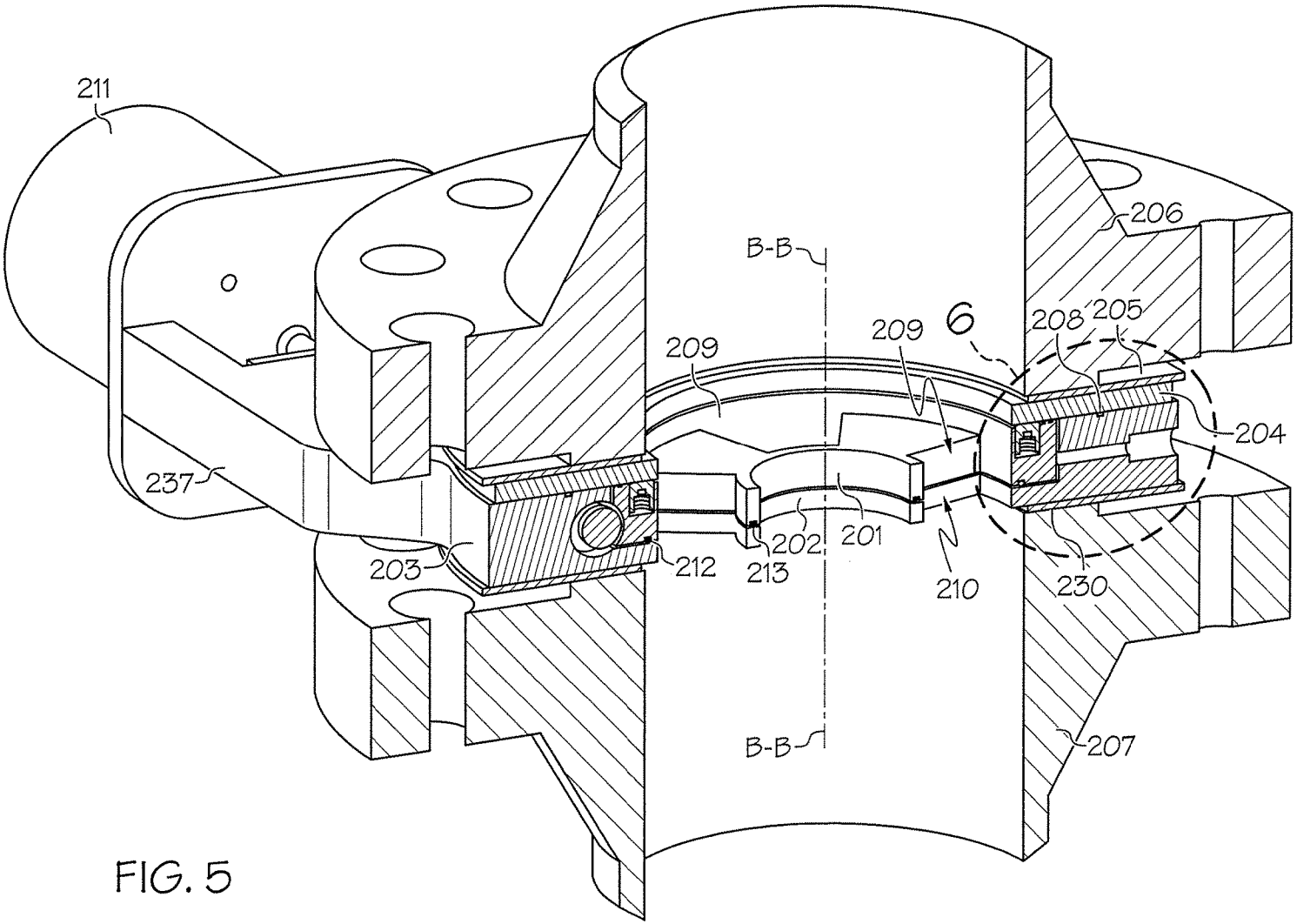
FIG. 5 is a side cross-sectional view of a 3-D representation of a flat, disc-like embodiment of the apparatus of the invention.

Also, looking at FIG. 5, it can be appreciated that the upper and lower windowed plates 201, 202 have mating contours allowing the rotatable upper plate 201 to rotatably slide over the fixed lower plate 202 as it rotates about this central axis B-B. Rotation of the upper plate 201 relative to the fixed lower plate 202 causes their respective plate ports 209, 210 to be selectively aligned with one another. Therefore, the plate ports can be aligned in any configuration to create any size opening area or effective orifice size for a pulsation control device within a reciprocating compressor.

Figure 7:
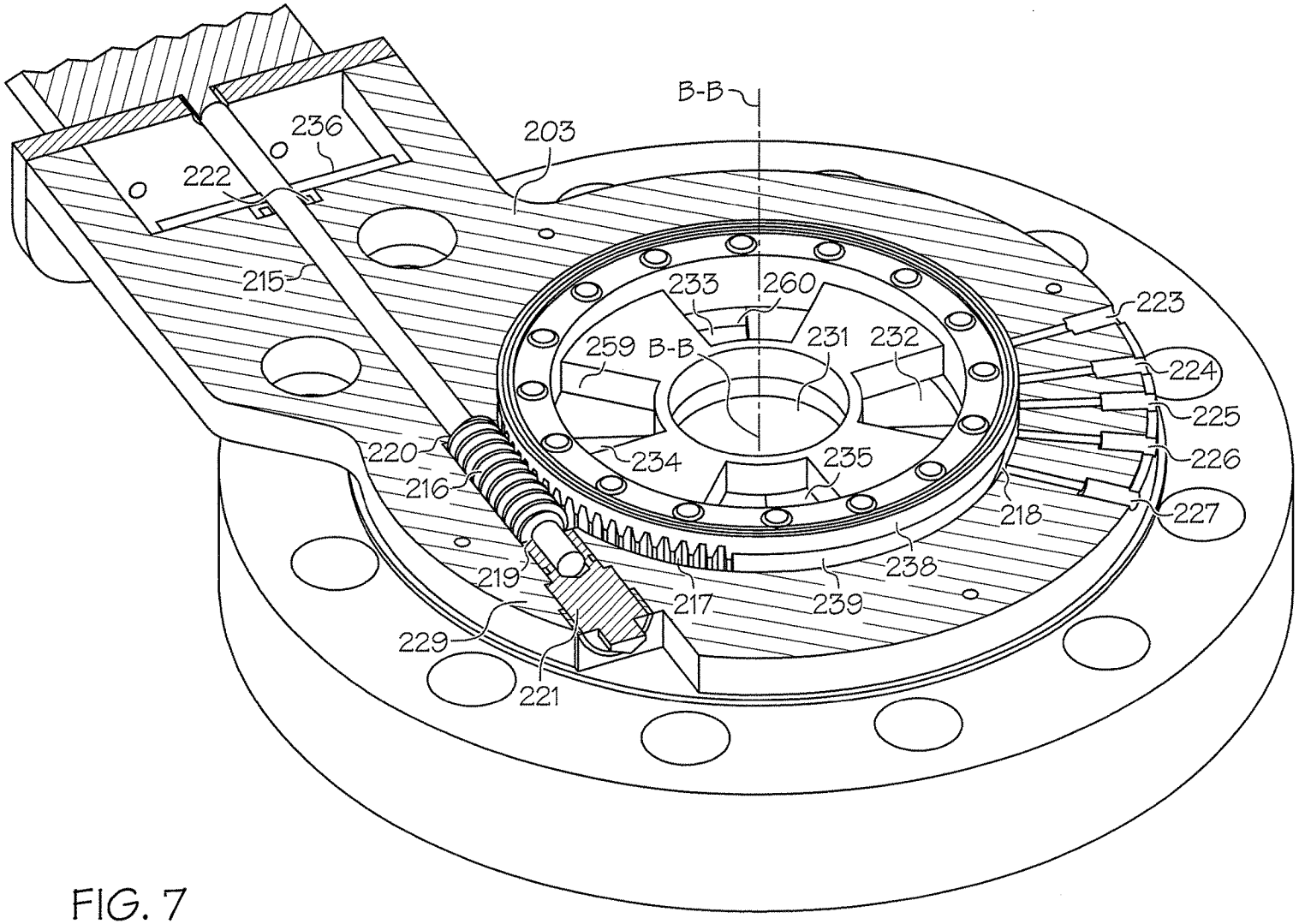
FIG. 7 is an expanded cross-sectional view as viewed from the top of a flat, disc-like embodiment of the apparatus of the invention having a plurality of plate ports.
Figure 8A:
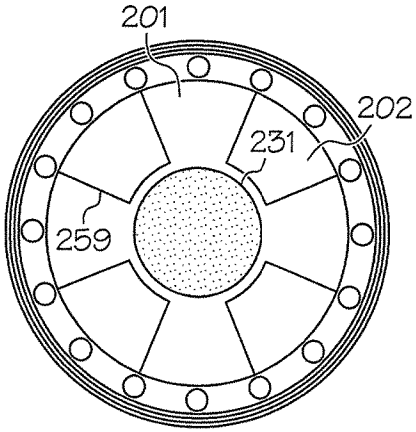
FIGS. 8A through 8E show a series of top views inside the upper windowed plate of the embodiment of FIG. 5, showing the flow passage openings in the plate ports as the upper windowed plate is rotated from fully closed (8A) to fully open (8E).

In use, flow enters the large internal diameter of the upper windowed plate 201 and progresses through the smaller internal diameter of the central cylindrical port 231 (see FIG. 7) created by the upper windowed plate 201 and the lower windowed plate 202. As shown in FIG. 7, the relative alignment of the upper plate ports 259 of the rotatable upper windowed plate 201 with the lower plate ports 260 of the fixed lower windowed plate 202 determines opening area or the effective orifice size or restriction of the pulsation control device. When the alignment between the two windowed plates is out of line, such that the opening between the upper and lower plate ports 259, 260 in the upper and lower windowed plates is substantially closed, as shown in FIG. 8A, all of the flow must pass through the central cylindrical port 231. This minimum position creates the smallest effective orifice size and the highest resistance to flow.

Figure 8B:
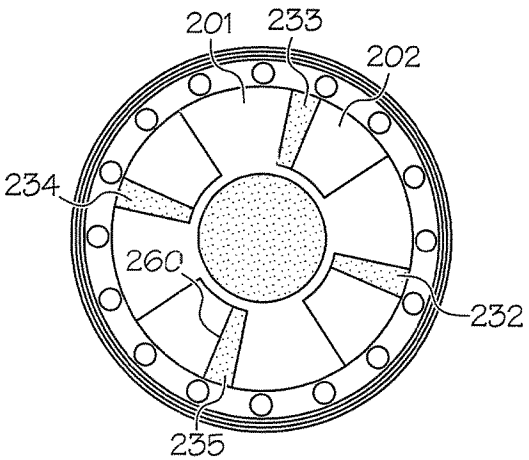
Figure 8C:
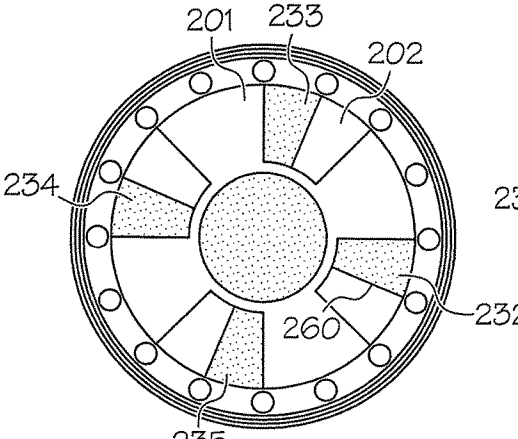
Figure 8D:
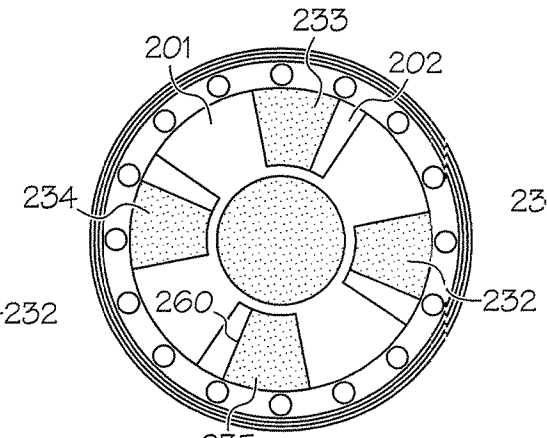
Figure 8E:
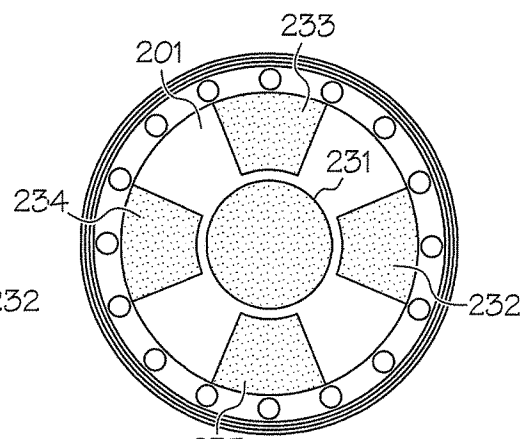

As shown in FIG. 8B, rotating the upper windowed plate 201 in a clockwise direction relative to the lower windowed plate 202, gradually increases the area of the openings 232, 233, 234, 235 (see also FIG. 7) between the plurality of plate ports of the upper and lower windowed plates to permit flow to pass through the plate ports, as well as through the central cylindrical port 231. This increases the effective orifice size to a Beta ratio that is larger than the minimum built-in Beta ratio and reduces the resistance to flow. Further clockwise rotation of the upper windowed plate, as shown in FIGS. 8C and 8D, further increases the plate port areas and the effective orifice size to larger and larger Beta ratios, further reducing the resistance to flow. In the limiting case, the maximum position occurs when the upper windowed plate is rotated to a position where its plate ports are in line with the plate ports of the lower windowed plate, causing the plate port areas to be fully open (see FIG. 8E). This maximizes the effective orifice size and Beta ratio and minimizes the resistance to flow.

The upper windowed plate 201 is typically rotated in one direction within the lower windowed plate 202 to reduce the effective orifice size, and in an opposite direction to increase the effective orifice size. Looking at FIG. 7, the upper windowed plate 201 contains a flange 238 having gear teeth 217 located in a section of its lower rim that engage helical teeth 216 in a drive gear and shaft 215. As the drive gear and shaft 215 is rotated by a mechanical means, the helical teeth 216 engage the gear teeth 217 in the rim of the upper flange 239 to cause the upper windowed plate 201 to be rotated so as to change the orientation of the ports 259 in the upper windowed plate with respect to the ports 260 in the lower windowed plate 202. This allows the user to change the effective flow area or orifice area of the DVO while the compressor is operating and pressurized. An upper locator bushing 212 (see FIGS. 5 and 6) and a lower locator bushing 213 (see FIG. 5) align and position the upper windowed plate 201 to the lower windowed plate 202, providing radial and axial support and alignment, preventing vibratory motion of the upper windowed plate, and maintaining a small clearance between the cages to prevent metal-to-metal contact, wear, and excessive resistance to rotation of the upper windowed plate.

Looking at FIG. 7, one or more mechanical stops, markers or notches 218 may be located at another position in the rim 239 of the flange 238 of the upper windowed plate 201. These notches 218 can be used to locate or measure the angular position of the upper windowed plate 201 for orienting its ports 259 relative to the corresponding ports 260 in the lower windowed plate 202 to adjust the flow area through the openings 232, 233, 234, and 235 of the plate ports between the upper and lower windowed plates. As illustrated, ports 259 of the upper windowed plate line up with the ports 260 of the lower windowed plate to form opening 233. Openings 232, 234 and 235 are also formed by the ports 259 and 260 (not labeled over these openings) of the upper and lower windowed plates. One embodiment of the invention utilizes one or more markers, which may include, but are not limited to, step changes in the flange lower rim diameter, or metal pins affixed to protrude radially from the flange lower rim, or shallow holes drilled radially into the flange lower rim. The location of the marker(s) may be measured by an electronic sensor(s) mounted in one or more sensor ports 223, 224, 225, 226, 227 located within the flange 203 of the fixed lower windowed plate 202 to determine the angular position of the rotatable upper windowed plate 201 as it is being rotated to a new position by the gear and shaft assembly 215.

In another embodiment, fixed mechanical stops embedded in the flange 238 of the upper windowed plate (not shown) contact a pin, step or other mechanical means of limiting rotational travel of the upper windowed plate 201 to a predetermined position. In this embodiment, the DVO is limited to positions corresponding to the limits imposed by fixed mechanical stops.

In yet another embodiment, the lower rim 239 of the flange of the upper windowed plate 201 may contain a notch (not shown) in the shape of a "v" groove, slot, hole or other geometric form. An external detent actuator (not shown), controlled by electrical, pneumatic or hydraulic or manual mechanical means, contains a pin that engages the "v" groove, slot, hole or other geometric form to prevent rotation of the upper windowed plate 201. The pin can be withdrawn from such engagement with the "v" groove when it is necessary to rotate the upper windowed plate 201 to a new position, and then reinserted when the new position is reached to hold the upper windowed plate in the new position.

Looking at FIG. 5, the lower windowed plate 202 contains an integral flange 203 which typically includes one or more extensions (e.g., 237). One extension may be used for mounting the external actuator or the electronic sensors (not shown). Another extension 237 may be used for mounting a pneumatic, electrical or hydraulic actuator or motor 211 or other means to rotate the drive gear and shaft assembly 215.

The drive gear and shaft assembly 215 may be rotated in a clockwise or a counter-clockwise direction, either manually with a wrench engaging opposing flats on the shaft, or with a hand crank attached either permanently or temporarily to the shaft, or with an electrical, pneumatic or hydraulically powered actuator or motor that engages the drive end of the gear and shaft assembly 215.

As can be appreciated by viewing FIG. 7, the drive gear and shaft assembly 215 is held in position radially and axially by at least two bushings or bearings 219, 220. One bushing or bearing 220 is held within a cylindrical bore in the flange 203 of the lower windowed plate and the other bearing or bushing 219 is held in place by a bearing holder 221 that is inserted into a cylindrical bore in the flange 203 of the lower windowed plate. The bearing holder 221 may be secured by threads that engage it with threads in the cylindrical bore in the flange 203 of the lower windowed plate or by bolts, snap ring or other mechanical means. A seal 229 prevents leakage of high pressure gas to the atmosphere. A rotary shaft seal 222, held in place by a retainer 236 prevents high pressure gas from leaking along the shaft and gear assembly 215 to the atmosphere.

Figure 6:
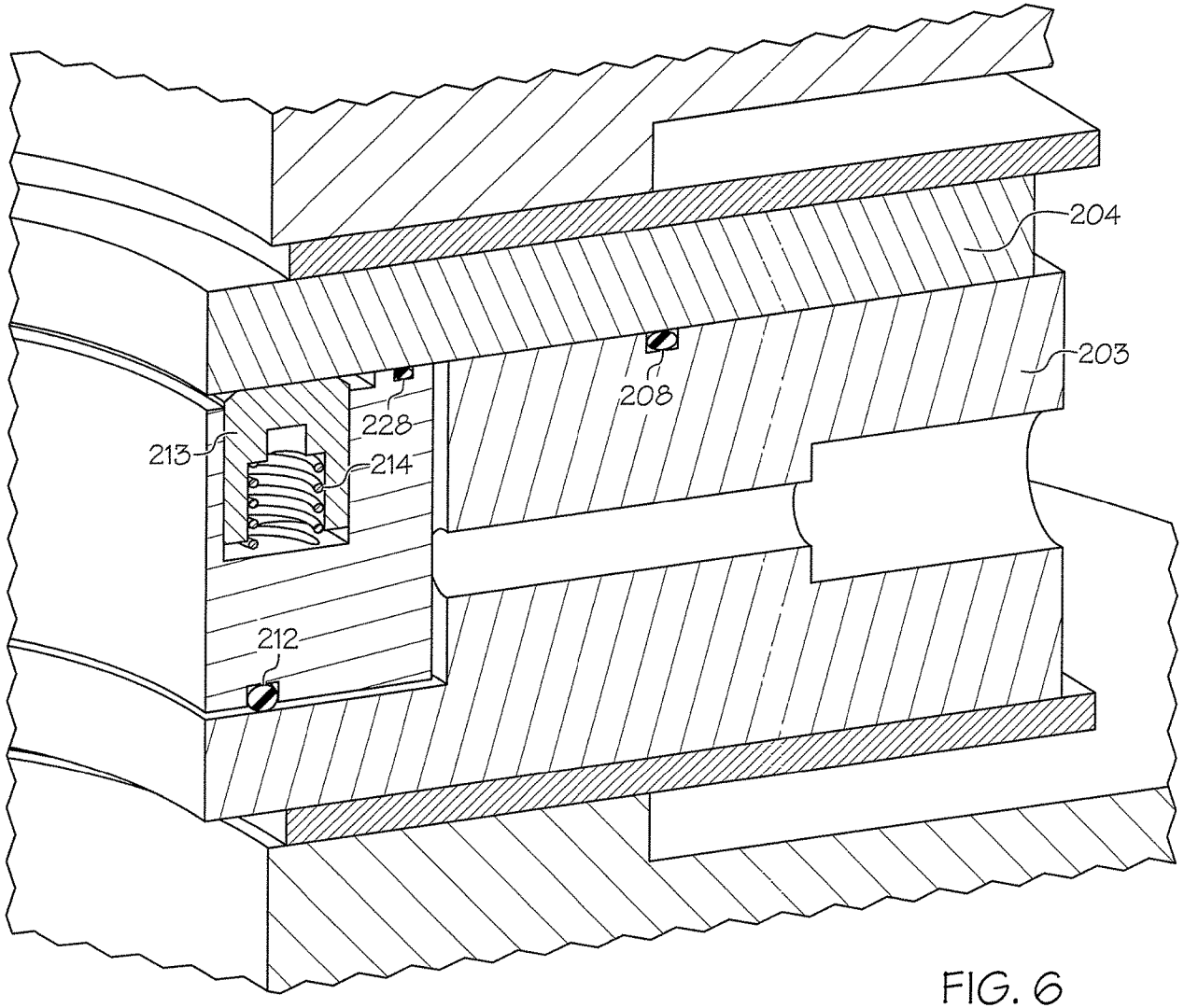
FIG. 6 is an expanded cross-sectional view of the area within the square frame shown in FIG. 5.

As shown in FIG. 6, the flange 238 of the upper windowed plate 201 is positioned within a shallow bore in the flange 203 of the lower windowed plate 202. A top plate 204, connected to the flange 203 of the lower windowed plate by three or more threaded cap screws (not shown), captures the flange 238 of the upper windowed plate to position it axially in the assembly. A seal 208 prevents the leakage of high pressure gas through the joint between the top plate 204 and the flange 203 of the lower windowed plate 202 to the atmosphere. A minimum of three to a maximum of about twelve spring-energized support pads 213 are used to provide a limited axial preload force which holds the upper windowed plate 201 in an axial position against the bushings 212, 213 within the assembly, but permits rotation when needed to change the effective orifice area. The support pads 213 are constructed of corrosion resistant metallic bearing material, such as bronze, brass, tin-plated or lead-plated aluminum or brass, or composite sintered metals, or a non-metallic bearing material, such as filled-Teflon, PEEK, or other suitable material. A helical spring 214 under each support pad is compressed within the assembly to provide a suitable axial force that holds the upper windowed plate in position, but permits rotation when it is necessary to rotate the upper windowed plate to a different position to change the effective orifice area. A contaminant barrier 228 may be used to prevent the accumulation of dirt, rust, liquid or other contaminants in the gas stream from accumulating around the gear teeth 216, 217 (FIG. 7).

Case Studies

The following case studies provide insight into the problems faced with the current use of prior art fixed orifice plates, and provides a quantification of the penalties associated with having fixed orifice diameters along with the benefits of having variable orifice diameters.

The compressor in this case study is a common industrial reciprocating compressor that is commonly used throughout the natural gas compression industry. The compressor has four "throws" oriented in a horizontally opposed arrangement with two throws on each horizontal side of the crankcase. A common four-throw crankshaft with a 5.5 in. stroke drives each of the four throws. The compressor is driven through a flexible coupling by a natural gas reciprocating engine rated at 1680 horsepower at 1200 rpm. About 180 horsepower is consumed to drive auxiliary equipment, leaving 1500 horsepower available for driving the compressor at the 1200 rpm maximum rated speed. The engine and compressor can operate at continuous speeds of 900 to 1200 rpm. A double acting compressor cylinder having a bore diameter of 8.75 in. is mounted on each of the four compressor throws, and the system is configured such that the four cylinders operate in parallel.

The compressor is applied in an application that collects gas from multiple gas wells and pressurizes it for transport through a pipeline for processing and eventually to sales. Over the life of the application, the inlet, or suction, pressure will vary with time as individual gas wells come on and off line in an often unpredictable manner. In addition, the suction pressure will trend to lower levels over longer periods of time as the gas wells mature and production volumes and pressures decline. In order to accommodate the wide range of operating conditions within the rated limits of the compressor and the gas engine driver, the operating speed, suction pressure, volumetric clearance and number of active compressor ends have to be varied, often by means of automatic controls. This type of application is very common, and the design of an optimal pulsation control system is not only very challenging, it can be impossible to design a single fixed system that satisfactorily accommodates the entire operation range that is specified for the application. In this case the end user provided a total of eighteen different operating conditions that defined the wide range over which the system was required to operate.

Figure 9:
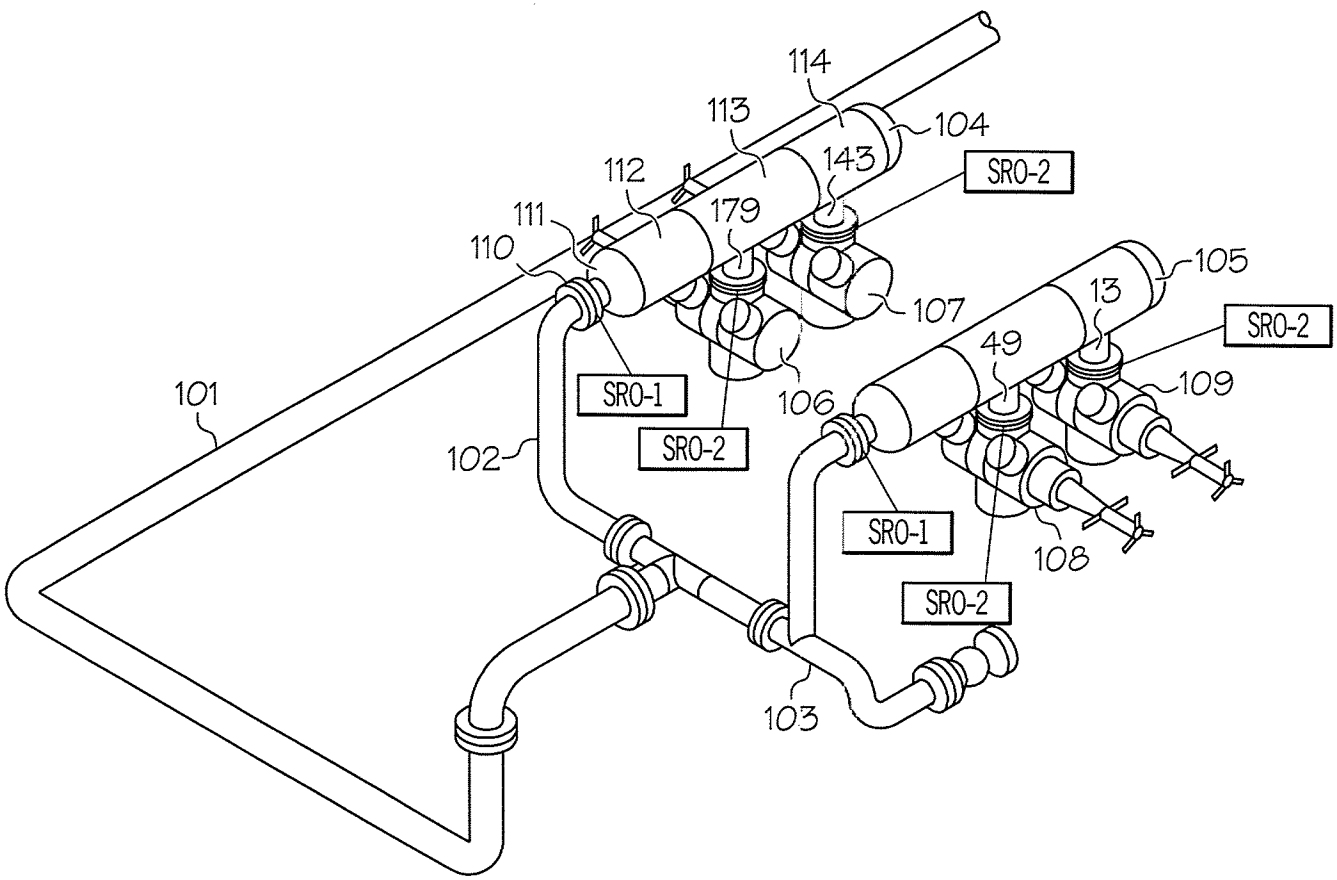
FIG. 9 is an isometric representation of the suction system for a reciprocating compressor for the case study of FIGS. 11 A and 11B.

FIG. 9 is an isometric drawing of the suction piping and pulsation control system that was designed for this application. The supply line 101 to the compressor cylinders 106, 107, 108, 109 splits into two branches 102,103. Each branch feeds a three-chambered suction pulsation bottle 104,105 that bridges the suction of two cylinders 106,107 and 108,109 on one side of the compressor. A fixed pulsation dampening orifice or Suction Restrictive Orifice (SRO-1) is placed between the pipe flange 110 and the inlet connection flange 111 on the suction pulsation bottle 104. The flow goes through the fixed orifice (SRO-1) into the first of the three chambers inside the three-chambered suction pulsation bottle 104. The first chamber 112 is connected to each of two other chambers 113,114 by internal pipes (not shown) that serve as choke tubes to create volume-choke-volume acoustic filters. Each of the other two internal chambers 113,114 is centered over a compressor cylinder 106,107 and connected to the cylinder suction flange with a short riser pipe. Fixed pulsation dampening orifices (SRO-2) are placed between the riser flange and the cylinder suction flange for each cylinder. An identical configuration is used on the opposite side of the compressor for the other two cylinders.

Figure 10:
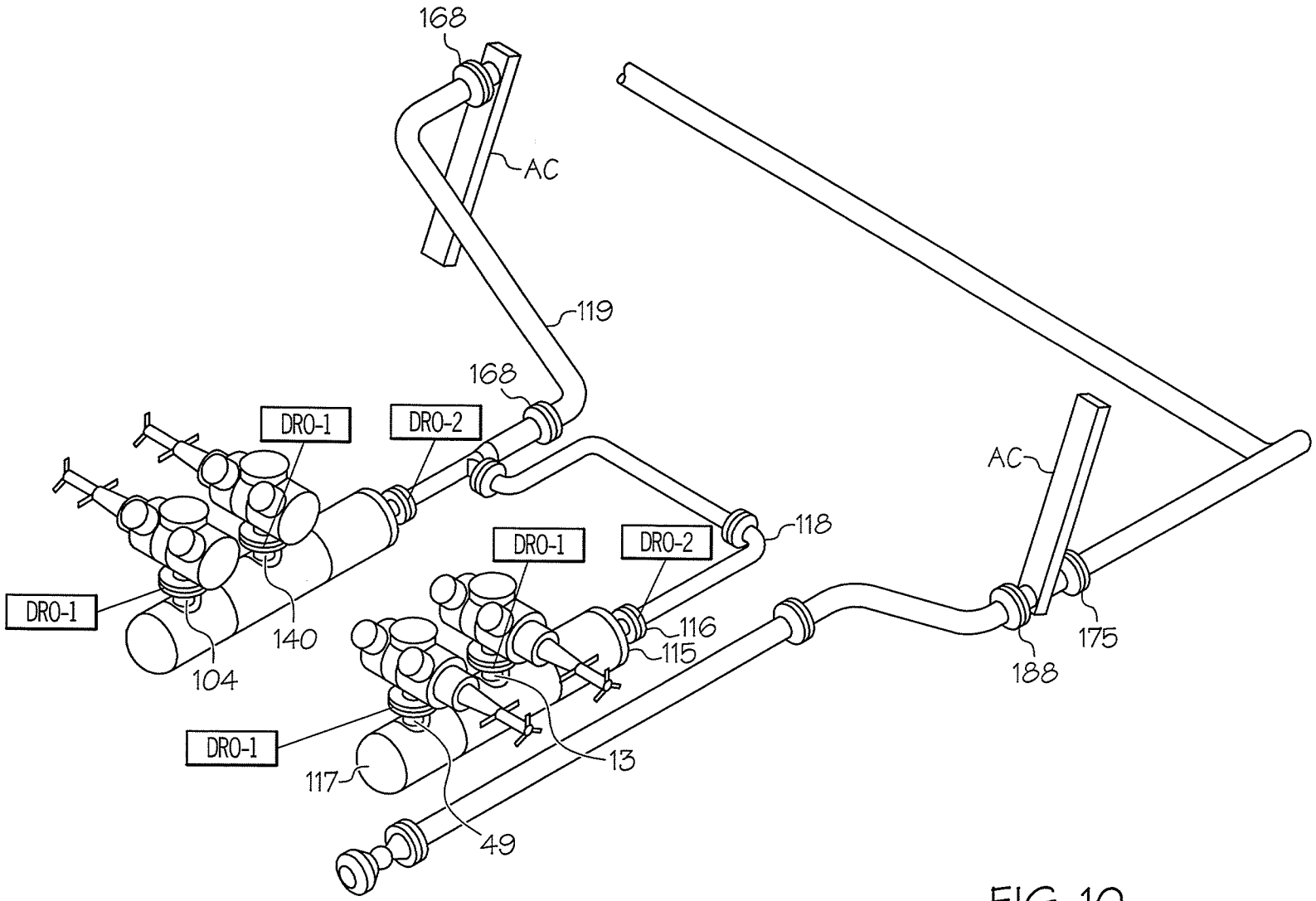
FIG. 10 is an isometric representation of the discharge system for a reciprocating compressor for the case study of FIGS. 11 A and 11B.

FIG. 10 is an isometric drawing of the discharge piping and pulsation control system that was designed for this application. Fixed pulsation dampening orifices or Discharge Restrictive Orifices [DRO-1] are placed between a three-chambered discharge pulsation bottle riser flange and the cylinder discharge flange for each cylinder. Each of the short risers feeds into a separate internal chamber that is centered below a compressor cylinder. Each internal chamber is connected to an end chamber of the three-chambered discharge pulsation bottle by an internal pipe that serves as a choke tube to create a volume-choke-volume acoustic filter. A fixed pulsation dampening orifice [DRO-2] is placed between the outlet connection flange 115 on the discharge pulsation bottle 117 and the pipe flange 116. The flow goes through the fixed orifice [DRO-2] into a pipe branch 118 that joins a branch from an identical configuration on the opposite side of the compressor to a common outlet or discharge line 119.

As is customary practice, the compressor and piping system was modeled and analyzed over the range of operating conditions to determine the pulsations throughout the system. For the sake of brevity, the results of analyzing only three of the eighteen specified operating conditions are presented in FIGS. 11 A and 11B.

Case 1 is a 1200 rpm operating point with all four cylinders in double acting mode, but with volumetric clearance added to each head or lower cylinder end to reduce the capacity to a rate of 86.5 million standard cubic feet per day (MMSCFD).

Case 3 is a 1084 rpm operating point with three of the four cylinders in single acting mode (i.e., suction valves removed or disabled to allow gas to bypass them, leaving only the crank or frame end of the cylinder able to compress gas) and with the fourth cylinder in double acting mode, but with volumetric clearance added to the head or lower end of that cylinder to reduce capacity to a rate of 58.0 MMSCFD.

Case 8 is a 1200 rpm operating point with all four cylinders in double acting mode with no volumetric clearance added to the head or lower cylinder end for a capacity of 149.9 MMSCFD. This provides maximum capacity from the compressor.

As is customary with the current state of the art, a common set of fixed pulsation control orifices was selected for all operating conditions. The common set consists of 5.50 in. diameter orifices for [SRO-1], 3.75 in. diameter orifices for [SRO-2], 3.50 in. diameter orifices for [DRO-1], and 4.25 in. diameter orifices for [DRO-2].

The data in FIGS. 11 A and 11B shows that a common set of fixed pulsation control orifices is far from optimal. The set was selected to provide best overall performance at Operating Case 1, which is the highest power condition of the cases shown. With the common set of fixed orifices, the suction (from the suction header to the compressor suction flange) and discharge (from the compressor discharge flange to the discharge header) pressure drops are 1.96% and 1.93%, respectively. The suction and discharge pulsations are controlled to 1.9% and 1.3% of the line pressure, respectively, and the associated power consumed by the suction and discharge pressure drops is 2.60%.

A more optimal set for Operating Case 1 controls the suction and discharge pulsations to 2.2% and 1.4%, respectively, which were acceptable for that case. The larger diameter orifices in the optimal set resulted in suction and discharge pressure drops of 1.53% and 0.99%, respectively, with an associated power consumption of 1.69%. The savings translates to $7.35 in driver fuel cost per day, based on a fuel cost of $3.50/MMBTU. If the compressor were to operate at this operating condition all the time, with the assumption of the industry norm of 96% availability, use of the optimal orifice set would result in annual fuel savings of $2,575.44.

Operating Case 3 provides an example of a different issue that occurs with the use of a common set of fixed pulsation control orifices. Case 3 is a low flow condition in which three of the four cylinders are operated in single acting mode. Single acting cylinder operation generally creates a more difficult pulsation control challenge. Power losses with the common set are 1.45%; however, the pulsation control is not adequate. Suction and discharge pulsations with the common set are 11.8% and 5.8%, respectively. These are unacceptably high and result in a high risk of pulsation related vibration, meter measurement problems and other safety and reliability problems upstream of, within and downstream of the compressor system. An optimal set of pulsation control orifices for Operating Case 3 result in suction and discharge pulsations of 7.2% and 5.6%, respectively. Although these are still higher than would be preferred, they are substantially better than the common orifice set and they represent the best practical alternative for this operating condition without more drastic redesign of the system. The resulting power consumption increases to 2.60%, however that is a reasonable premium for reducing the risk of pulsation related reliability problems.

Operating Case 8 provides an example of another problem associated with using a common set of fixed pulsation control orifices in a compressor that must operate over a wide range of flow conditions. At Operating Case 8, the common orifice set controls suction and discharge pulsations to 0.5% and 0.2%, respectively. This exceptional pulsation control comes with a significant power cost, however, for this low pressure ratio operating case, as the resulting power consumption is 11.06%. A more optimal set of pulsation control orifices for Operating Case 8 results in a power consumption of 3.02%. Suction and discharge pulsations remain very low, even with the larger optimal larger diameter orifice set. The power savings translates to $58.86 in driver fuel cost per day, based on a fuel cost of $3.50/MMBTU. If the compressor were to operate at this operating condition all the time, with the assumption of the industry norm of 96% availability, use of the optimal orifice set would result in annual fuel savings of $20,624.12.

In the foregoing Case Study, without the benefit of the present invention, the options are limited to: (1) restricting the compressor operation to a limited operating range, i.e., a low flow of about 60 MMSCFD to a high flow of about 80 MMSCFD with the use of the common set of fixed plate orifices, or (2) to frequently stop the compressor, vent the system to atmospheric pressure, physically unbolt ten sets of bolted flanges to change the fixed orifice plates to sets that are more optimal for the intended operation, reassemble the ten sets of flanges, purge the system to remove air, pressurize the system again, and then restart the compressor.

Option (1) could result in flow being limited by as much as 69.9 MMSCFD, or the difference between the desired 149.9 MMSCFD maximum capacity and the 80 MMSCFD limit imposed on the unit due to use of the fixed orifices. Based on a $3.50/MMBTU gas price, this lost production opportunity would be nearly $14,000 per day. Option (2) is generally not a practical alternative because of its high cost, its labor intensity, the environmental impact from the more frequent venting of gas that contains methane (a green house gas) and volatile organic compounds from the system to the atmosphere, and the fact that flow conditions are not always predictable or controllable, which could pose a risk to operational safety. Assuming, however, that such a change could be tolerated and the fixed orifice plates could be changed out in one 24 hour period, based on a wellhead natural gas price of $3.50/MMBTU, the typical lost production alone would be at least $12,000 for the unit in this case study. This does not include the cost of labor and material required for changing the orifice plates.

In the foregoing Case Study, the use of a dynamic variable orifice (DVO) of the present invention at each of the ten orifice locations would provide a practical means of expanding the compressor flow range from a low flow of 40 MMSCFD to a high flow of 120 MMSCFD while achieving effective pulsation control and reasonable pressure drop associated power consumption.

Although the initial application of the present invention as explained herein is for the dampening of pulsations within reciprocating compressor systems, there are other applications for the present invention. These include, but are not limited to, any compressor, pump, metering or piping systems containing a gaseous fluid, a liquid, or a bi-phase fluid, where pulsation dampening is required or where variable flow control is necessary or beneficial.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope of the invention.

What is claimed is:

1. A pulsation dampening apparatus for providing a selectively variable size for a pulsation control orifice associated with a reciprocating compressor, the pulsation dampening apparatus comprising:

a) a rotatable inner conical cage including a plurality of inner conical cage ports;

b) a fixed outer conical cage including a plurality of outer conical cage ports; and c) a central cylindrical port created by alignment of the inner conical cage and the outer conical cage about a central axis, wherein the inner conical cage and the outer conical cage have mating contours allowing the rotatable inner conical cage to slide within the fixed outer conical cage as it rotates about the central axis, rotation of the inner conical cage causing the plurality of inner conical cage ports and the plurality of outer conical cage ports to be selectively aligned, the relative alignment of the plurality of inner conical cage ports with the plurality of outer conical cage ports determining the effective size of the pulsation control orifice within the reciprocating compressor.

2. The apparatus of claim 1, wherein the inner conical cage is rotated in one direction within the outer conical cage to reduce the effective orifice size, and in an opposite direction to increase the effective orifice size.

3. The apparatus of claim 1, further comprising a drive gear and shaft assembly having helical teeth, the inner conical cage further including a flange having gear teeth which engage the helical teeth of the drive gear and shaft assembly, wherein rotation of the helical teeth causes the inner conical cage to be rotated, rotation of the inner conical cage causing a change in the orientation of the plurality of inner conical cage ports with respect to the plurality of outer conical cage ports, thereby allowing a user to create any desired effective size for the pulsation control orifice within the reciprocating compressor.

4. The apparatus of claim 3, wherein rotation of the inner conical cage can be done while the reciprocating compressor is operating and while the fluid within the reciprocating compressor is pressurized.

5. The apparatus of claim 1, further comprising an upper locator bushing and a lower locator bushing, wherein the bushings align and position the inner conical cage with the outer conical cage, thereby providing radial and axial support and alignment, preventing vibratory motion of the inner conical cage, and maintaining a clearance between the conical cages to prevent metal-to-metal contact, wear, and excessive resistance to rotation of the inner conical cage.

6. The apparatus of claim 1, wherein the Beta ratio at a minimum position is between 0.3 and 0.7, wherein the minimum position is achieved when the alignment of the inner and outer conical cages causes the inner and outer conical cage ports to be substantially out of line and fully closed such that all of the flow must pass through the central cylindrical port.

7. The apparatus of claim 6, wherein the Beta ratio at the minimum position is 0.4.

8. The apparatus of claim 1, wherein the Beta ratio at the maximum position is between 0.5 and 0.9 wherein the maximum position is achieved when the alignment of the inner and outer conical cages causes the inner and outer conical cage ports to be substantially in line and fully open such that the flow passes through the fully open conical cage ports as well as the central cylindrical port.

9. The apparatus of claim 8, wherein the Beta ratio at the maximum position is 0.7.

* * * * *